United States Patent [19]

Fabris

[11] Patent Number: 4,680,953

[45] Date of Patent: Jul. 21, 1987

[54] ROLLER ENTRY GUIDE RELATING TO A ROD MILL

[75] Inventor: Mario Fabris, Grimsby, Canada

[73] Assignee: Fabris Industrial Manufacturing Limited, Winona, Canada

[21] Appl. No.: 785,719

[22] Filed: Oct. 9, 1985

[51] Int. Cl.[4] ..... B21B 39/16

[52] U.S. Cl. ..... 72/250; 226/187; 242/157 R; 254/396

[58] Field of Search ..... 72/250; 242/157 R; 226/168, 181, 186, 187; 254/396, 397

[56] References Cited

U.S. PATENT DOCUMENTS 4,039,107 8/1977 Boley ..... 72/250 X

FOREIGN PATENT DOCUMENTS 0027850 8/1971 Japan ..... 72/250

0811623 4/1959 United Kingdom ..... 72/250

*Primary Examiner*—Robert L. Spruill

*Assistant Examiner*—Steve Katz

*Attorney, Agent, or Firm*—Fleit, Jacobson, Cohn & Price

[57] ABSTRACT

A roller entry guide to guide material along a longitudinal axis has a body and a pair of generally parallel roller assemblies pivotally mounted on the body for rotation about an axis normal to the longitudinal axis. Each of the roller assemblies is located on an opposite side of the longitudinal axis to define a passageway for material moving along the axis and includes at least one roller rotatably attached thereto. The guide also includes a wedge that acts between the roller assemblies and the body. The wedge has a pair of legs disposed at either side of the body. These legs have tapered portions at the ends thereof which are operable on respective roller assemblies. An adjustment assembly is operable on the wedge to position the wedge to induce rotation of the roller assemblies about a vertical axis, and cause the rollers to be moved simultaneously and to equal distances towards or away from the longitudinal axis.

6 Claims, 2 Drawing Figures

ROLLER ENTRY GUIDE RELATING TO A ROD MILL

BACKGROUND OF THE INVENTION

The present invention relates to roller entry guides, and more particularly to a roller entry guide that provides the possibility of adjustment during operation.

DESCRIPTION OF THE PRIOR ART

Roller entry guides are used in a rod mill to guide the rod to the next stage of the mill. Such guides conventionally have a tapering inlet chute that guides the rod between a set of rollers. The rollers then ensure that the rod is presented to the next stage of the mill in the correct orientation.

The roller entry guides are normally set up at the start of a production run so that the spacing between the rollers corresponds to the nominal diameter of the rods that will be passing between them. It has been found however, that variations in the stock size induce wear on the rollers which leads to frequent stoppages for adjustment and maintenance.

Proposals have been made to adjust the clearance between roller entry guides having two rollers. Although these proposals provide for lateral movement of the roller entry guides, they do not allow for adjustment of the rollers while material is passing through the guide. Production must be stopped to adjust the rollers, resulting in a considerable amount of downtime. Also, most roller guide designs require separate adjustment of each roller. If the adjustments are not made carefully, the rollers will be spaced at different distances from the longitudinal axis of the roller entry guide. Consequently, the rod will not be centered correctly and will not enter the next stage at the correct orientation.

It is therefore an object of the present invention to obviate or mitigate the above-mentioned disadvantages.

SUMMARY OF THE INVENTION

According therefore to the present invention there is provided a roller entry guide to guide material along a longitudinal axis. The guide has a body and a pair of generally parallel roller assemblies pivotally mounted on the body for rotation about an axis normal to said longitudinal axis. Each of the roller assemblies is located on an opposite side of the longitudinal axis to define a passageway for material moving along the axis and includes at least one roller rotatably attached thereto. The guide also includes wedge means that acts between the roller assemblies and the body. The wedge means has a pair of legs disposed between the body and respective roller assemblies. These legs have tapered portions at the ends thereof which are operable on respective roller assemblies. Adjustment means are operable on the wedge means to move the wedge means to induce rotation of said roller assemblies about said normal axis, and cause said rollers to be moved simulataneously and to equal and opposite distances towards or away from said longitudinal axis.

The present invention provides for conjoint adjustment of the roller assemblies while material is passing through the guide, by merely operating the adjustment means and ensures equal and opposite movement of the rollers relative to the longitudinal axis.

BRIEF DESCRIPTION OF THE DRAWINGS

An embodiment of the invention will now be described by way of example only with reference to the accompanying drawings in which.

BRIEF DESCRIPTION OF THE PREFERRED EMBODIMENT

Figure 1:
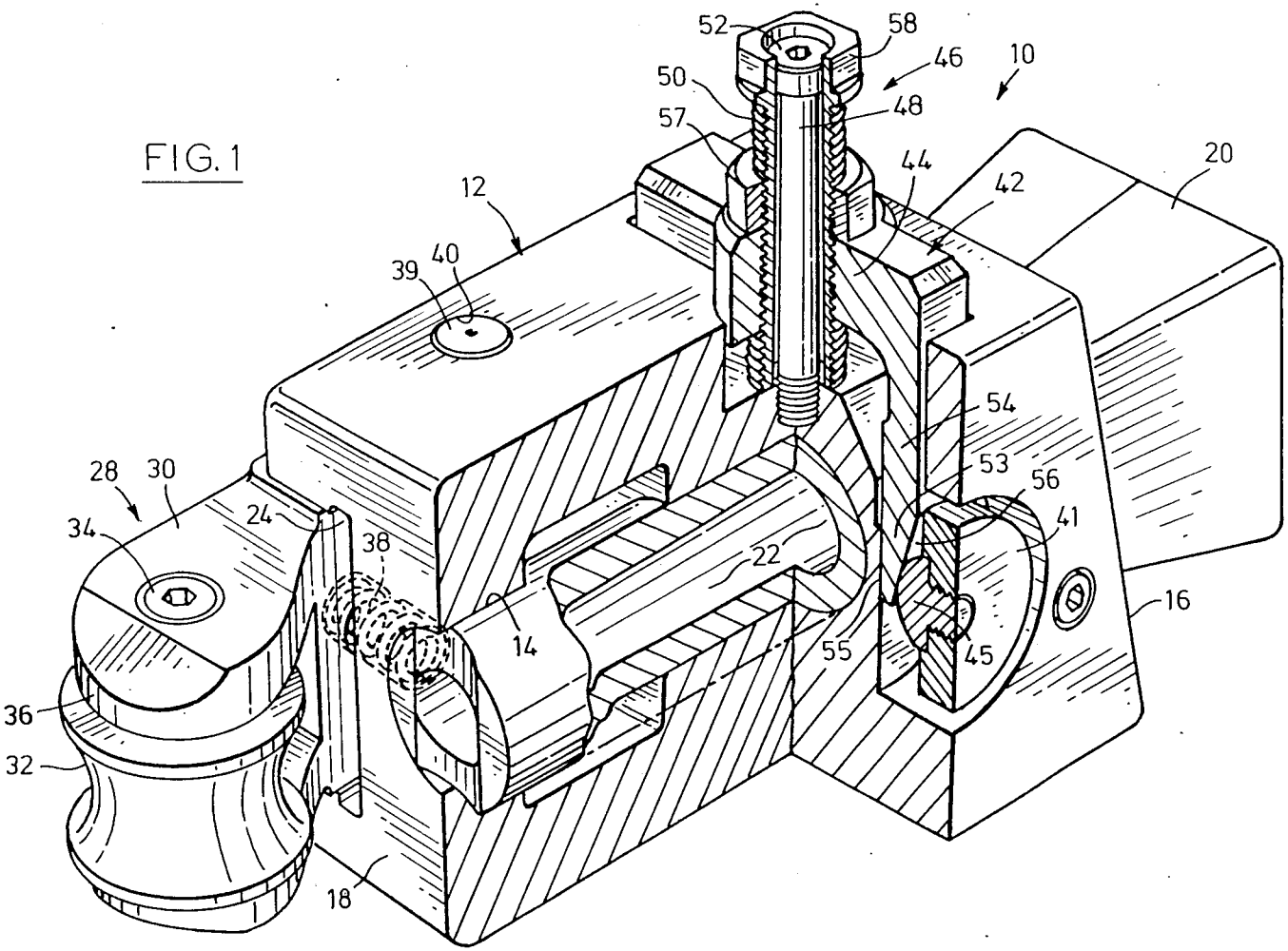
FIG. 1 is a general cross-sectional perspective view of a roller entry guide.

Referring now to the drawings, a roller entry guide 10 has a body member generally designated 12 which is provided with a bore 14 that extends along a longitudinal axis of the guide 10 from a rear face 16 to a front face 18 of the body member 12. An inlet chute 20 having a throat 22 of progressively reducing cross-section is held within the bore 14.

Located in channels 24, 26 on each side of the body and projecting forwardly of the body are a pair of roller assemblies 28 each of which comprises an arm 30 carrying a roller 32. The rollers 32 are mounted on vertical spindles 34 at respective forward ends 36 of the arms 30, and are provided with conventional bearing assemblies for rotation about a vertical axis.

The arms 30 are pivotally supported in the body by pins 39, mounted approximately mid-way on the arms. These pins are mounted at their ends in respective vertically extending bores 40 on either side of the body member 12 so that they are rotatable about respective vertical pivot axes.

Springs 38 is provided between the arms 30 and the body member 12 adjacent to the rollers, to bias the arms 30 away from the body 12.

At the rear ends 41 of the arms buttons 45 are provided which project inwardly toward the longitudinal axis. Located between these buttons 45 and the body member 12, are tapered portions 53 of a pair of legs 54 which are part of a yoke 42. One side 55 of each of these tapered portions 53 reacts against the body member and the other side 56 is inclined. The upper portions of the legs are connected by a central portion 44 of the yoke which is mounted on the body by a threaded assembly 46. This threaded assembly has a pin 48 mounted on the body member 12 and a threaded sleeve 50 rotatably mounted on the outside of the pin 48. The upper end of the pin 48 is provided with a plug 52 and the upper end of the sleeve is provided with an adjustment surface 58, so that the sleeve can be rotated. A lock nut 57 is also provided on the sleeve at the top of the central portion 44.

Figure 2:
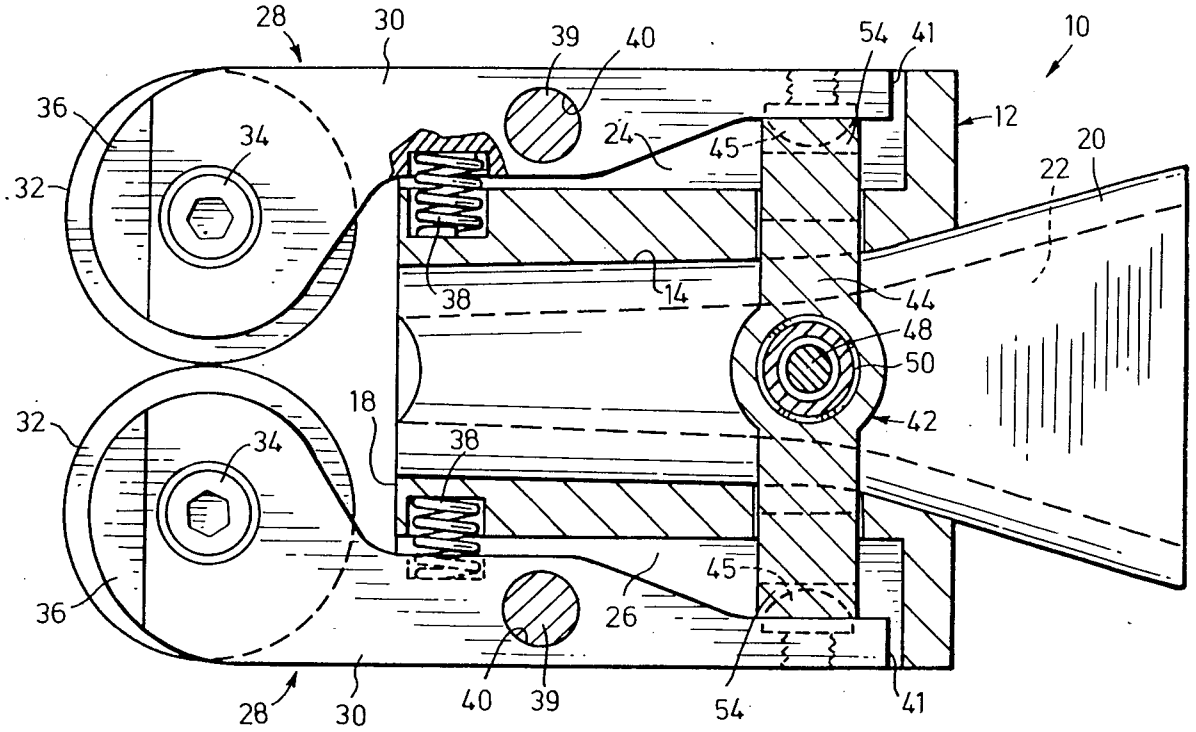
FIG. 2 is a sectional plan view, of the roller entry guide shown in FIG. 1.

The operation of the device will now be described with reference to FIGS. 1 and 2. Adjustment of the spacing between the rollers 32 is achieved by unscrewing the lock nut 57 and turning the adjustment surface 58 to rotate the threaded sleeve 50. The yoke 42 is prevented from rotating by the body 12 and is therefore moved in the vertical direction. When the yoke 42 is moved downwardly, the inclined portion 56 is moved downwardly past the buttons 45 causing the arms 30 to rotate about their respective vertical pivot axes. The rollers 32 are thereby moved simultaneously towards the longitudinal axis against the bias of the springs 38. When the yoke 42 is moved upwardly, the inclined portion 56 is moved upwardly past the buttons 45 causing the arms 30 to rotate about their respective pivot axes, and move the rollers simultaneously away from the longitudinal axis. In this way small adjustment may be made whilst maintaining the rollers centered on the axis.

We claim:

1. A roller entry guide to guide material along a longitudinal axis, said guide comprising:

a body;

a pair of generally parallel roller assemblies pivotally mounted on said body for rotation about a vertical axis, each of said roller assemblies being located on an opposite side of said longitudinal axis to define a passageway for material moving along said axis and including at least one roller rotatably attached thereto;

a yoke acting between the roller assemblies and said body, said yoke having a central portion with a pair of legs, one of said legs being disposed at each end of said central portion, said legs having tapered portions at the ends thereof which are operable on respective roller assemblies said legs being supported by said body; and adjustment means operable on said yoke to raise or lower said yoke to induce conjoint rotation of said roller assemblies about a vertical axis, thereby causing said rollers to move simultaneously and to equal and opposite distances towards or away from said longitudinal axis.

2. The roller entry guide as claimed in claim 1, wherein each of said roller assemblies includes an arm pivotally mounted on said body for rotation about an axis normal to said longitudinal axis, and a roller rotatably mounted on one end of said arm for rotation about an axis parallel to and spaced from said normal axis.

3. A roller entry guide as claimed in claim 2, wherein said arms each include a button at another end thereof which projects towards the longitudinal axis, said tapered portions of said legs being slidably engageable with respective buttons.

4. A roller entry guide as claimed in claim 1, wherein said adjustment means comprises a pin mounted on said body and passing through said yoke, with a threaded sleeve rotatably mounted thereon, said threaded sleeve having a lock nut mounted thereon adjacent to said yoke and an adjustment surface at an upper end thereof said yoke being raised or lowered upon rotation of said sleeve by said adjustment surface.

5. A roller entry guide as claimed in claim 2 including biasing means located between each of said arms and said body to restrain the arms in their adjusted position.

6. A roller entry guide as claimed in claim 2 wherein said roller assemblies are pivotally supported in the body pins located generally mid-way on said arms.

* * * * *